US007702266B2

(12) United States Patent
Kazaki et al.

(10) Patent No.: US 7,702,266 B2
(45) Date of Patent: Apr. 20, 2010

(54) IMAGE FORMING APPARATUS PROVIDED WITH ONE-COMPONENT DEVELOPMENT APPARATUS

(75) Inventors: Yuichi Kazaki, Nara (JP); Eiichi Kido, Nara (JP); Hiroaki Nakaya, Osaka (JP); Takayuki Yamanaka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 690 days.

(21) Appl. No.: 11/557,132

(22) Filed: Nov. 7, 2006

(65) Prior Publication Data

US 2007/0110482 A1 May 17, 2007

(30) Foreign Application Priority Data

Nov. 17, 2005 (JP) ..... 2005-333034

(51) Int. Cl.
*G03G 15/08* (2006.01)

(52) U.S. Cl. ..... 399/279; 399/284

(58) Field of Classification Search ..... 399/279, 399/284

See application file for complete search history.

(56) References Cited

U.S. PATENT DOCUMENTS 5,933,688 A * 8/1999 Suzuki et al. ..... 399/222
5,960,239 A * 9/1999 Toyoshima et al. ..... 399/284
2005/0220501 A1 * 10/2005 Toba et al. ..... 399/284

FOREIGN PATENT DOCUMENTS

| | | | |
|---|---|---|---|
| JP | 61-243473 | | 10/1986 |
| JP | 63036286 A | * | 2/1988 |
| JP | 02-150870 | | 6/1990 |
| JP | 04-281478 | | 10/1992 |
| JP | 2001-356589 | | 12/2001 |
| JP | 2003-270927 | | 9/2003 |

OTHER PUBLICATIONS

JP63036286 Abstract, Hirai et al. Feb. 16, 1988.*

* cited by examiner

*Primary Examiner*—David M Gray
*Assistant Examiner*—Ryan D Walsh
(74) *Attorney, Agent, or Firm*—Renner, Otto, Boisselle & Sklar, LLP

(57) ABSTRACT

One embodiment of an image forming apparatus according to the present invention includes an image forming apparatus provided with a one-component development apparatus having a toner layer regulating blade for regulating a thickness of a toner layer on a surface of a developer bearing member that contacts a photosensitive body, wherein at a non-development time after completion of operation of the developer bearing member, the developer bearing member is caused to rotate slightly in a direction reverse to that during development.

12 Claims, 6 Drawing Sheets

IMAGE FORMING APPARATUS PROVIDED WITH ONE-COMPONENT DEVELOPMENT APPARATUS

BACKGROUND OF THE INVENTION

This application claims priority under 35 U.S.C. §119(a) on Japanese Patent Application No. 2005-333034 filed in Japan on Nov. 17, 2005, the entire contents of which are hereby incorporated by reference.

The present invention is applied to image forming apparatuses that carry out image formation electrophotographically such as copiers, printers, and facsimile machines, and particularly relates to image forming apparatuses that are effective in removing toner that has adhered to a toner layer regulating blade in an image forming apparatus in which a nonmagnetic one-component development apparatus is installed.

Generally, in a nonmagnetic one-component development method, regardless of whether the toner is magnetic or nonmagnetic, a thin layer of charged one-component toner is formed on a developer bearing member and by conveying the thin layer by rotating a development roller to a development position facing a photosensitive drum on which a latent image has been formed, the latent image on the photosensitive drum is made manifest (developed). Here, in order to achieve a good image, it is essential that the toner thin layer is stably formed on the development roller so as to have a uniform charge and uniform thickness.

Generally, the charging of the toner layer on the development roller and the formation of the thin layer are carried out using a toner layer regulating blade that presses against the development roller with a predetermined pressure. In the charging of the toner layer and formation of the thin layer, toner adhesion to the toner layer regulating blade is caused due to long use, such that a good toner layer cannot be formed and may lead to image deterioration. That is, the toner layer regulating blade is continually in contact with the development roller with a predetermined pressure and due to frictional heat and the pressure thereof or environmental causes such as the temperature inside the apparatus, toner becomes attached (adhered) to the blade surface at contact positions where the toner layer regulating blade contacts the development roller and the vicinity thereof.

At first the adhered substance merely extends as a thin film on the surface and is at a level that presents no particular problem to image formation, but this builds up due to prolonged use and eventually exerts an adverse effect on images.

That is, the chargeability of the toner is worsened by the toner layer regulating blade due to the adhered substance, and the adhered substance blocks the inflow opening for toner between the toner layer regulating blade and the development roller, or forms mechanical roughness on the surface contacting the development roller, which leads to overall or local reductions in the toner layer thickness and local slippage (layer thickness increases), such that a uniform toner layer cannot be formed. As a result, for example, the density in images is reduced, and partial white streaks or partial black streaks (in the case of monochrome) appear.

Accordingly, to address these problems, development apparatuses are proposed that perform cleaning on the toner adhesion substance on the toner layer regulating blade (for example, see JP S61-243473A (hereinafter, "patent document 1") and JP H04-281478A (hereinafter, "patent document 2")).

The development apparatus of patent document 1 is configured so that in a development apparatus that develops an electrostatic latent image opposing a photosensitive drum using a one-component developer, the development roller is rotated by a predetermined angle at a non-development time in a direction reverse to that during development. Here, "predetermined angle" is an angle between a first toner layer regulating blade and a second toner layer regulating blade, which from FIG. 1 thereof is an angle of approximately 150 degrees.

Furthermore, in the development apparatus of patent document 2, when a printer apparatus is powered up, the development roller is rotated continuously for one minute in a direction reverse to that during development, then stopped for development to begin.

Thus, apparatuses have already been proposed that remove toner adhered to the toner layer regulating blade by rotating the development roller in a direction reverse to that during development.

However, with the development apparatus of patent document 1, since the angle for reverse rotation is as much as 150 degrees, there is a problem of outflow of toner from the development tank due to reverse rotation of the development roller. For this reason, in patent document 1, a second toner layer regulating blade is provided on a downstream side of the development region in order to prevent outflow of toner from the gap between the development roller and the development tank. That is, the second toner layer regulating blade is provided only for the purpose of preventing outflow of toner due to reverse rotation of the development roller. Furthermore, there is no mention whatsoever in patent document 1 as to whether or not the photosensitive drum is also made to rotate in reverse at the time of reverse rotation of the development roller. Consequently, in the case of causing only the development roller to rotate in reverse while the photosensitive drum is stopped, there is a problem of unnecessary friction on the contact surface thereof.

Moreover, with the development apparatus of patent document 2, since the driving for the reverse rotation of the development roller continues for as long as one minute, there is a problem even more than with patent document 1 of outflow of toner from the development tank due to reverse rotation of the development roller. However, no countermeasure whatsoever is conducted in regard to this in the development apparatus of patent document 2. Furthermore, since the drive motor for the photosensitive drum is also turned on during reverse rotation of the development roller, reverse rotation is performed while the development roller and the photosensitive drum are in a state of contact, which presents a problem of unnecessary friction being caused at both contact surfaces.

SUMMARY OF THE INVENTION

The present invention has been devised to solve these problems, and it is an object thereof to provide an image forming apparatus that solves the problem of toner outflow due to reverse rotation of the development roller and the problem of friction produced by the two contacting surfaces, and is capable of reliably removing toner that has adhered to the toner layer regulating blade.

An image forming apparatus according to the present invention includes an image forming apparatus provided with a one-component development apparatus having a toner layer regulating blade for regulating a thickness of a toner layer on a surface of a developer bearing member that contacts a photosensitive body, wherein at a non-development time after completion of operation of the developer bearing member (for example, after completion of one job), the developer bearing member is caused to rotate slightly in a direction reverse to that during development and the photosensitive body is also caused to simultaneously rotate in reverse when the developer bearing member is caused to rotate in reverse.

Here, reverse rotation of the developer bearing member is carried out after completion of operation of the developer bearing member because toner is compressed against the toner layer regulating blade at the point of operation completion and toner fusing can occur easily since the temperature in that vicinity is high. Accordingly, by carrying out slight reverse rotation of the developer bearing member before the fused toner completely hardens, toner that is adhering to the toner layer regulating blade in a compressed state can be reliably removed.

Furthermore, since the developer bearing member and the photosensitive body are connected by a gear train, control of the forward rotation and reverse rotation of the developer bearing member and the photosensitive body can be carried out easily with control based on driving of a single motor. Thus, no unnecessary friction is caused at the contact surface (development region) between the developer bearing member and the photosensitive body due to reverse rotation of the developer bearing member, and no abrasion or scratching of the developer bearing member and the photosensitive body is caused by reverse rotation.

Here, a development bias voltage may be applied during the reverse rotation of from 0 V to +300 V, which is opposite to that during image formation. The toner can be prevented from adhering to the surface of the photosensitive body during reverse rotation by applying the development bias at from 0 V to +300 V.

Here, a rotation angle at a time of reverse rotation of a surface of the developer bearing member may be set within a range of approximately 7 to 23 degrees. By merely causing slight reverse rotation of the developer bearing member upon completion of operation in this way, toner that has adhered or stuck to the toner layer regulating blade can be easily and reliably removed.

It should be noted that in a development apparatus according to the present invention, two toner layer regulating blades may be provided, a first toner layer regulating blade provided at an upstream side of the rotation direction of the developer bearing member and a second toner layer regulating blade provided at a downstream side of the rotation direction. Fusing of toner occurs at both toner layer regulating blades, so the fusing of toner can be prevented simultaneously.

Furthermore, a toner scattering prevention sheet may be provided such that a tip end thereof contacts a surface of the photosensitive body, near an opening of a development tank that accommodates the developer bearing member. By providing the toner scattering prevention sheet, it is possible to prevent outflow and scattering of toner to the outside of the development tank due to reverse rotation. Furthermore, an optical component is preferably arranged near the photosensitive body and near the development tank. By providing the toner scattering prevention sheet, it is possible to prevent the optical component from becoming soiled by toner sputtering.

Here, a movement distance of the surface of the developer bearing member at a time of reverse rotation may be within a range from a position at a time of development stoppage to immediately prior to where the toner scattering prevention sheet that contacts the photosensitive body goes into a non-contact state with the photosensitive body. By keeping within this range, the toner scattering prevention sheet can always be maintained in a state of contact with the photosensitive body even when the developer bearing member rotates in reverse, and therefore it is possible to reliably prevent outflow and scattering of toner to the outside of the development tank.

Furthermore, in a state where the toner scattering prevention sheet is formed of an elastic material and a tip end thereof is arranged in a curved shape so as to press against a surface of the photosensitive body, a movement distance of the surface of the developer bearing member at a time of reverse rotation may be within a range in which a pressure contact line between the tip end of the toner scattering prevention sheet and the surface of the photosensitive body does not deviate even when a curvature direction of the toner scattering prevention sheet changes due to reverse rotation. By keeping within this range, the toner scattering prevention sheet can always be maintained in a state of contact with the photosensitive body even when the developer bearing member rotates in reverse, and therefore it is possible to prevent outflow and scattering of toner to the outside of the development tank.

Furthermore, in a state where the toner scattering prevention sheet is formed of an elastic material and a tip end thereof is arranged in a curved shape so as to press against a surface of the photosensitive body, when a line of intersection between a straight line joining a fixed end center of the toner scattering prevention sheet and a rotational center of the photosensitive body and the surface of the photosensitive body is set as a reference line, a movement distance of the surface of the developer bearing member at a time of reverse rotation may be within a range in which the tip end of the toner scattering prevention sheet does not exceed the reference line. By keeping within this range, the toner scattering prevention sheet does not undergo a change in its curvature direction even when the developer bearing member is rotated in reverse. When the curvature direction changes, there is a possibility that the tip end portion of the toner scattering prevention sheet will rebound due to its own elasticity, and when it rebounds there is a possibility that toner inside the development tank will outflow or scatter to the outside due to the force of the toner scattering prevention sheet, but since there is no change in the curvature direction of the toner scattering prevention sheet according to the present invention, this problem does not arise. That is, outflow and scattering of toner to the outside of the development tank can be reliably prevented.

DESCRIPTION OF THE PREFERRED EMBODIMENTS

Hereinafter, an image forming apparatus provided with a development apparatus according to an embodiment of the present invention will be described with reference to the accompanying drawings.

<Overall Description of Image Forming Apparatus>

Figure 1:
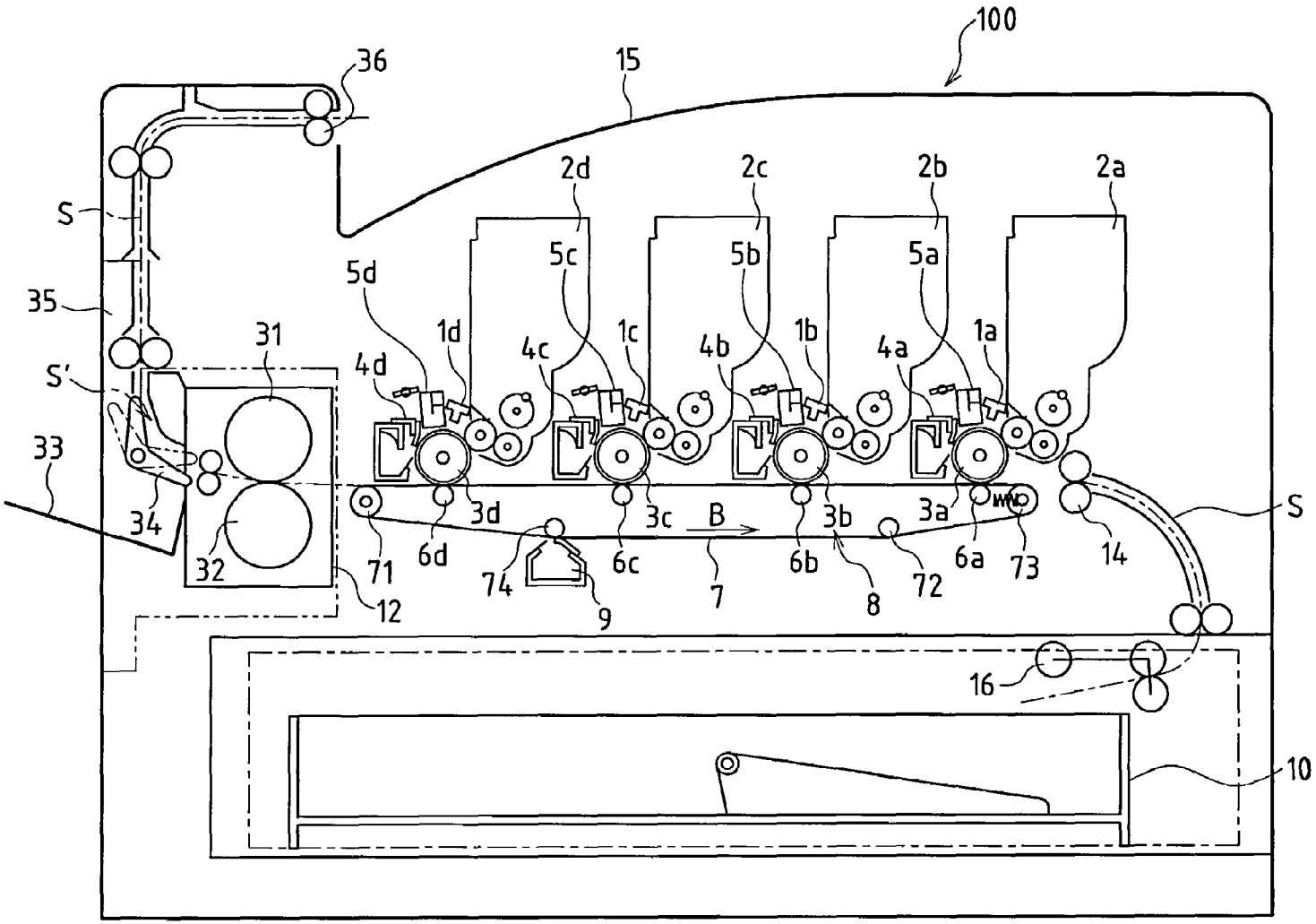
FIG. 1 is a schematic cross-sectional view showing a structure of a digital color multifunction machine as a color image forming apparatus according to the present invention.

FIG. 1 is a schematic cross-sectional view showing a structure of a digital color multifunction machine (hereinafter, simply referred to as "multifunction machine") 100 as a color image forming apparatus according to the present embodiment.

The multifunction machine 100 1 is a system that forms multicolor and single color images on predetermined sheets (sheet of recording paper) in response to image data transmitted from an external portion and is constituted by items such as exposure units (1*a*, 1*b*, 1*c*, and 1*d*), development apparatuses 2, photosensitive drums 3, charging units (5*a*, 5*b*, 5*c*, and 5*d*), cleaning units (4*a*, 4*b*, 4*c*, and 4*d*), a transfer/transport belt unit 8, a fixing unit 12, a sheet transport path S, a paper feed tray 10, and discharge trays 15 and 33.

It should be noted that image data handled in the multifunction machine 100 corresponds to color images using the colors black (K), cyan (C), magenta (M), and yellow (Y). Consequently, the exposure units (1*a*, 1*b*, 1*c*, and 1*d*), the development apparatuses 2 (2*a*, 2*b*, 2*c*, and 2*d*), the photosensitive drums 3 (3*a*, 3*b*, 3*c*, and 3*d*), the charging units (5*a*, 5*b*, 5*c*, and 5*d*), and the cleaning units (4*a*, 4*b*, 4*c*, and 4*d*) are configured in four image forming stations, with these being arranged respectively in four groups to form four latent images according to the colors and these are set such that "a" is black, "b" is cyan, "c" is magenta, and "d" is yellow. The photosensitive drums 3 are arranged (mounted) in a substantially central portion of the multifunction machine 100 and the exposure units ("optical component" in the claims) 1 are arranged in a vicinity of the photosensitive drums 3.

The charging units (5*a*, 5*b*, 5*c*, and 5*d*) are negative charging means for uniformly charging a surface of the photosensitive drums 3 to a predetermined electric potential, and in addition to contact types such as roller and brush chargers, charge-type charging units are also used as shown in FIG. 1.

As the exposure units (1*a*, 1*b*, 1*c*, and 1*d*), an EL or LED write head for example in which light-emitting elements are lined up in an array, or a laser scanning unit (LSU) provided with a laser irradiation portion and reflector mirrors is used. These have a function of exposing the charged photosensitive drums 3 according to image data that is inputted, thereby forming electrostatic latent images, which correspond to the image data, on surfaces thereof.

The development apparatuses 2 use (K, C, M, and Y) toner to develop the electrostatic latent images formed on the photosensitive drums. The cleaning units (4*a*, 4*b*, 4*c*, and 4*d*) remove and collect toner that is residual on the surfaces of the photosensitive drums after development and image transfer.

The transfer/transport belt unit 8 positioned below the photosensitive drums 3 is provided with a transfer belt 7, a transfer belt drive roller 71, a transfer belt tension roller 73, transfer belt idler rollers 72 and 74, transfer rollers 6 (6*a*, 6*b*, 6*c*, and 6*d*), and a transfer belt cleaning unit 9.

The transfer belt 7 spans in a tensioned state the transfer belt drive roller 71, the transfer belt tension roller 73, the transfer rollers 6, and the transfer belt idler rollers 72 and 74, and these cause the transfer belt 7 to be driven to rotate in the direction of arrow B.

The transfer rollers 6 are rotatably supported on transfer roller mounting portions in an unshown housing of the transfer/transport belt unit 8 and apply a transfer bias for transferring the toner images on the photosensitive drums 3 to a sheet (sheet of recording paper) that is fastened and conveyed on the transfer belt 7.

The transfer belt 7 is arranged so as to contact the photosensitive drums 3 and has a function of forming a color toner image (multicolor toner image) by successively transferring and superimposing the toner image of each color formed on the photosensitive drums 3 onto the sheet (sheet of recording paper). The transfer belt is formed as an endless shape using a film of a thickness in a range of 100 μm to 150 μm.

Transfer of the toner images from the photosensitive drums 3, which have a diameter of 30 mm, to the sheet (sheet of recording paper) is carried out by the transfer rollers 6 that are in contact with a rear side of the transfer belt 7. A high voltage transfer bias (a high voltage (+) that has inverse polarity to the charge polarity (−) of the toner) is applied to the transfer rollers 6 to achieve transfer of the toner images. The transfer rollers are based on metal (for example stainless steel) shafts with a diameter of 8 to 10 mm and the surfaces thereof are covered by an electrically conductive elastic material (for example, EPDM and urethane foam or the like). With this electrically conductive elastic material, it is possible to apply a uniform high voltage to the sheet of recording paper (sheet). In the present embodiment, the transfer rollers 6 are used as transfer electrodes, but it is also possible to use other objects such as brushes.

Furthermore, since toner that adheres to the transfer belt 7 due to contact with the photosensitive drums 3 is a cause of scumming on the back side of the sheets of recording paper, it is removed and collected by the transfer belt cleaning unit 9. The transfer belt cleaning unit 9 is provided with a cleaning blade for example as a cleaning member that contacts the transfer belt 7, and the transfer belt 7 that is contacted by the cleaning blade is supported from a rear side by the transfer belt idler roller 74.

The paper feed tray 10 is for storing the sheets (sheets of recording paper) that are to be used for image formation and is arranged under the image forming unit of the multifunction machine 100. Furthermore, the discharge tray 15 arranged at an upper portion of the multifunction machine 100 is for facedown placement of sheets that have been printed, and the discharge tray 33 arranged at a side portion of the multifunction machine is for face-up placement of sheets on which image formation has been completed.

An "S" shaped sheet transport path S is provided in the multifunction machine 100 for sending the sheets in the paper feed tray 10 to the discharge tray 15 via the transfer unit 8 and the fixing unit 12. Moreover, a pickup roller 16, registration rollers 14, the fixing unit 12, a transport direction switching guide 34, and carry rollers 36 that convey the sheets are arranged in a vicinity of the sheet transport path S from the paper feed tray 10 to the discharge tray 15 and discharge tray 33.

The carry rollers 36 are small-size rollers for facilitating and assisting in conveying the sheets, and a plurality of these are provided along the sheet transport path S. The pickup roller 16 is provided at an end portion of the paper feed tray 10 and is a pull-in roller that feeds sheets one by one from the paper feed tray 10 to the sheet transport path S.

The transport direction switching guide 34 is rotatably provided at a side cover 35 and can separate sheets midway from the transport path S and discharge the sheets to the discharge tray 33 by changing the state indicated by a solid line to a state indicated by a dashed line. In a case of the state indicated by the solid line, sheets are discharged to the upper portion discharge tray 15 passing on a transport portion S' (a portion of the sheet transport path S) formed between the fixing unit 12 and the side cover 35/transport direction switching guide 34.

Furthermore, the registration rollers 14 temporarily hold the sheets that are conveyed in the sheet transport path S. They also have a function of conveying sheets with good timing matched to the rotation of the photosensitive drums 3 so that toner images on the photosensitive drums 3 can be superimposed and transferred well to the sheets.

That is, based on a detection signal outputted from an unshown pre-registration detection switch, the registration rollers 14 are set to convey the sheet so that a leading edge of the toner image on each of the photosensitive drums 3 is aligned with a leading edge of an image formation region on the sheet.

The fixing unit 12 is provided with items such as a hot roller 31 and a pressure roller 32, and the hot roller 31 and the pressure roller 32 are configured so as to rotate while sandwiching the sheet.

Furthermore, the hot roller 31 is controlled by a control portion so as to become a predetermined fixing temperature based on a signal from an unshown temperature detector, and has a function of melting, mixing, and pressing the multicolor toner image that has been transferred to the sheet to thermally fix it to the sheet by applying thermocompression to the sheet along with the pressure roller 32.

It should be noted that the sheet on which the multicolor toner image has been fixed is conveyed on an inverted discharge path of the sheet transport path S by the carry rollers 36 and discharged to the discharge tray 15 in an inverted state (with the multicolor toner image facing down).

<Description of Development Apparatus According to Present Invention>

Figure 2:
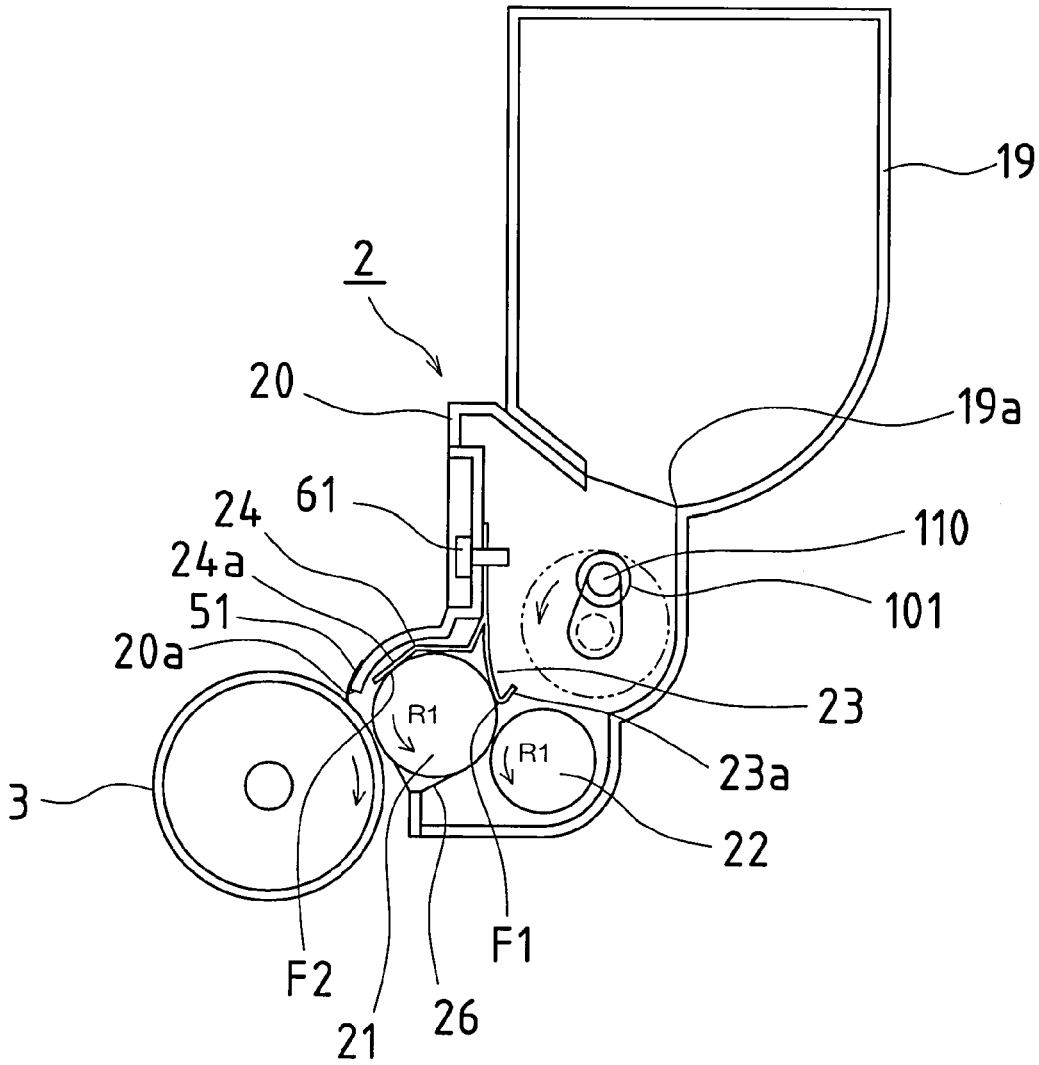
FIG. 2 is a schematic diagram illustrating a structural example of a nonmagnetic one-component development apparatus.
Figure 3:
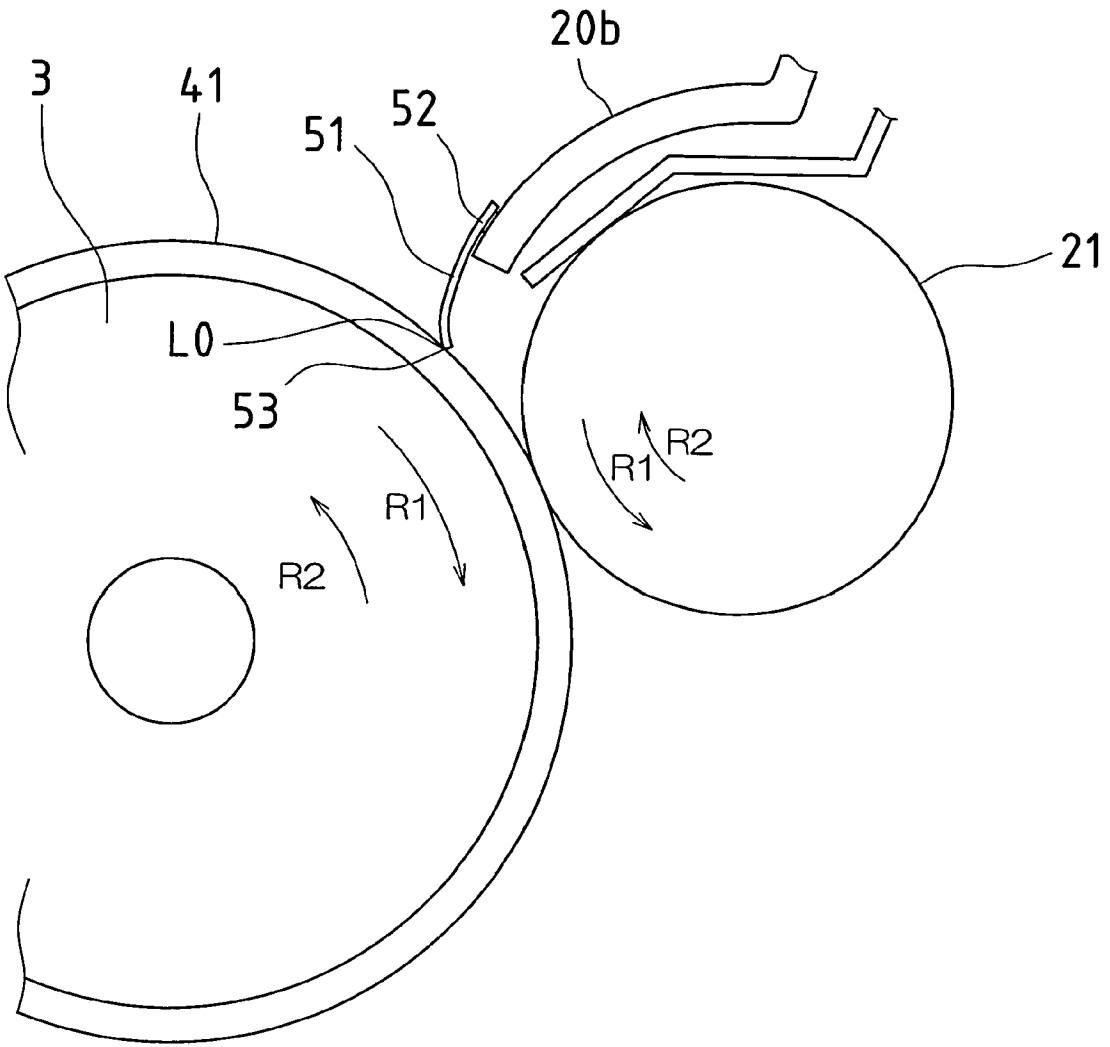
FIG. 3 is a schematic diagram illustrating an enlarged portion of the development apparatus shown in FIG. 2.

FIG. 2 and FIG. 3 are schematic diagrams illustrating structural examples of a nonmagnetic one-component development apparatus (hereinafter simply referred to as "development apparatus").

The development apparatus 2 is provided with a development tank 20 and a toner cartridge 19 that is detachably mounted on an upper side of the development tank 20. The toner cartridge 19 stores toner and this toner is supplied by naturally dropping into the development tank 20 from a toner replenishment opening 19*a*.

Inside the development tank 20, a development roller (corresponding to "developer bearing member" in the claims) 21 with a diameter of 16 mm is arranged horizontally (arranged perpendicular to the sheet of the drawing) so as to face the photosensitive drum 3 at an opening 20*a* of the development tank 20, and a toner supply roller 22 is arranged horizontally so as to be in contact with the development roller 21. Furthermore, a first toner layer regulating blade 23 and a second toner layer regulating blade 24 for regulating the layer thickness of toner adhering to the roller are arranged at the development roller 21. Also, a stainless steel shaft 110, which is a weighting member for agitating and conveying toner, is arranged horizontally at an upper portion vicinity of the thus-arranged toner supply roller 22 and in a vicinity of the first and second toner layer regulating blades 23 and 24, and is inserted into a coil spring 101 rotatably and in a manner so that a rotation angle thereof is restricted to a predetermined angle. However, the structure of the stainless steel shaft 110 and the coil spring 101 is not a principal component of the present invention and therefore detailed description is omitted here.

The first toner layer regulating blade 23 and the second toner layer regulating blade 24 are fastened with a screw 61 or the like to a frame portion of the development tank 20 such that their anchoring end sides overlap each other, and a tip end side of the first toner layer regulating blade 23 is arranged in a cantilever manner extending toward an upstream side of a rotation direction R1 of the development roller 21. This tip end portion is formed bent into a substantial "V" shape and a bent portion 23*a* thereof presses on a surface of the development roller 21 (a contact position F1). On the other hand, a tip end side of the second toner layer regulating blade 24 is arranged in a cantilever manner extending toward a downstream side of the rotation direction R1 of the development roller 21. A central portion thereof is formed bent in a substantially upside-down v-like shape, and a bent tip portion 24*a* presses on the surface of the development roller 21 (a contact position F2).

The toner supply roller 22 is in pressing contact against the development roller 21, and the rotation direction of the toner supply roller 22 is configured as the same direction R1 as for the development roller 21, that is, the movement directions of the surfaces of both rollers at a portion where the toner supply roller 22 opposes the development roller 21 are mutually reverse directions.

A voltage from an unshown bias power source is applied to the toner supply roller 22, and this voltage is set to a direction such that the toner is electrically pushed toward the development roller 21, for example, for a negative toner it is a bias voltage greater than the negative side. Toner that is charged by frictional contact with the toner supply roller 22 and supplied to the development roller 21 by the bias voltage is conveyed by rotational movement of the development roller 21 to a position where it contacts the first toner layer regulating blade 23. The toner on the development roller 21 is then regulated to a predetermined electrification amount and thickness by the first toner layer regulating blade 23 and further regulated by the second toner layer regulating blade 24, after which it is conveyed to a development region (a portion opposing the photosensitive drum 3 on which the electrostatic latent image has been formed) and a transition is made to a development process.

Undeveloped toner not used in the development process on the development roller 21 returns to inside the development tank 20 by the rotation of the development roller 21, but the charge in the residual toner on the development roller 21 is removed by a charge removal apparatus 26 arranged in front of the toner supply roller 22 then peeled off and collected for reuse by the pressing of the toner supply roller 22 and the development roller 21.

The photosensitive drum 3 is a negatively charged drum wherein an electrically conductive base material is grounded and the surface electric potential is charged to −550 V for example, and rotates at a peripheral speed Va (for example, 150 mm/s) in the direction shown by the arrow in FIG. 2.

The development roller 21 is an electrically conductive elastic roller constituted by an electrically conductive urethane rubber into which an electrically conductive agent such as carbon black has been added on a surface of a cylindrical member, and rotates at a peripheral speed Vb (for example, 225 mm/s) in the direction shown by the arrow in FIG. 2. A voltage of E1 (for example −300 V) is applied to the development roller 21 by the development bias power source via a shaft of an unshown electrically conductive support structure (such as stainless steel or an electrically conductive resin).

The toner supply roller 22 is constituted by an electrically conductive urethane foam for both agitating and removing toner after development, and rotates at a peripheral speed Vc (for example, 133 mm/s) in the arrow direction. A voltage of E2 (for example −400 V) is applied to the toner supply roller 22 by a supply bias power source via a shaft of an unshown electrically conductive support structure (such as stainless steel or an electrically conductive resin).

Nonmagnetic one-component toner that has been negatively charged in advance by the toner supply roller 22 and that has transitioned to the surface of the development roller 21 is conveyed by the rotation of the development roller 21 to the positions where the first and second toner layer regulating blades 23 and 24 contact the roller.

The first and second toner layer regulating blades 23 and 24 are electrically conductive (stainless steel, phosphor bronze, an electrically conductive resin, or the like) board shaped members having a thickness of 0.1 mm, are formed as cantilevered blade spring structures as described above, and contact the development roller 21 with a linear pressure of approximately 15 to 30 gf/cm. A voltage of E3 (for example, −400 V) is applied to the first and second toner layer regulating blades 23 and 24 by an unshown bias power source.

After the toner layer on the development roller 21 is regulated to predetermined amounts of toner adherence and toner charge by the first and second toner layer regulating blades 23 and 24, it is conveyed to a development region that faces and contacts the photosensitive drum 3 by rotation of the development roller 21 and contact inversion development is carried out.

As shown in the enlargement of FIG. 3, with the development apparatus 2 of the above-described structure in the present invention, a toner scattering prevention sheet 51 is attached at an upper curved frame portion 20*b* of the development tank 20 covering an upper portion side of the development roller 21 so as to cover the opening 20*a*. That is, an anchoring end 52 of the toner scattering prevention sheet 51 is fastened to the upper curved frame portion 20*b* using a screw (or an adhesive) and a tip end 53 is arranged so as to contact a surface 41 of the photosensitive drum 3. The toner scattering prevention sheet 51 is formed of an elastic material such as urethane foam for example, and the tip end 53 is arranged in a curved form (arranged in a state illustrated by a solid line in FIG. 6) so as to press on the surface 41 of the photosensitive drum 3. Here, when a distance from a fixed end center 52*a* of the toner scattering prevention sheet 51 to the surface 41 of the photosensitive drum 3 is set to 3.5 mm, a length by which the toner scattering prevention sheet 51 protrudes from its fixed end center 52*a* is approximately 4.5 mm.

<Description of Operations Inside the Apparatus>

Figure 4:
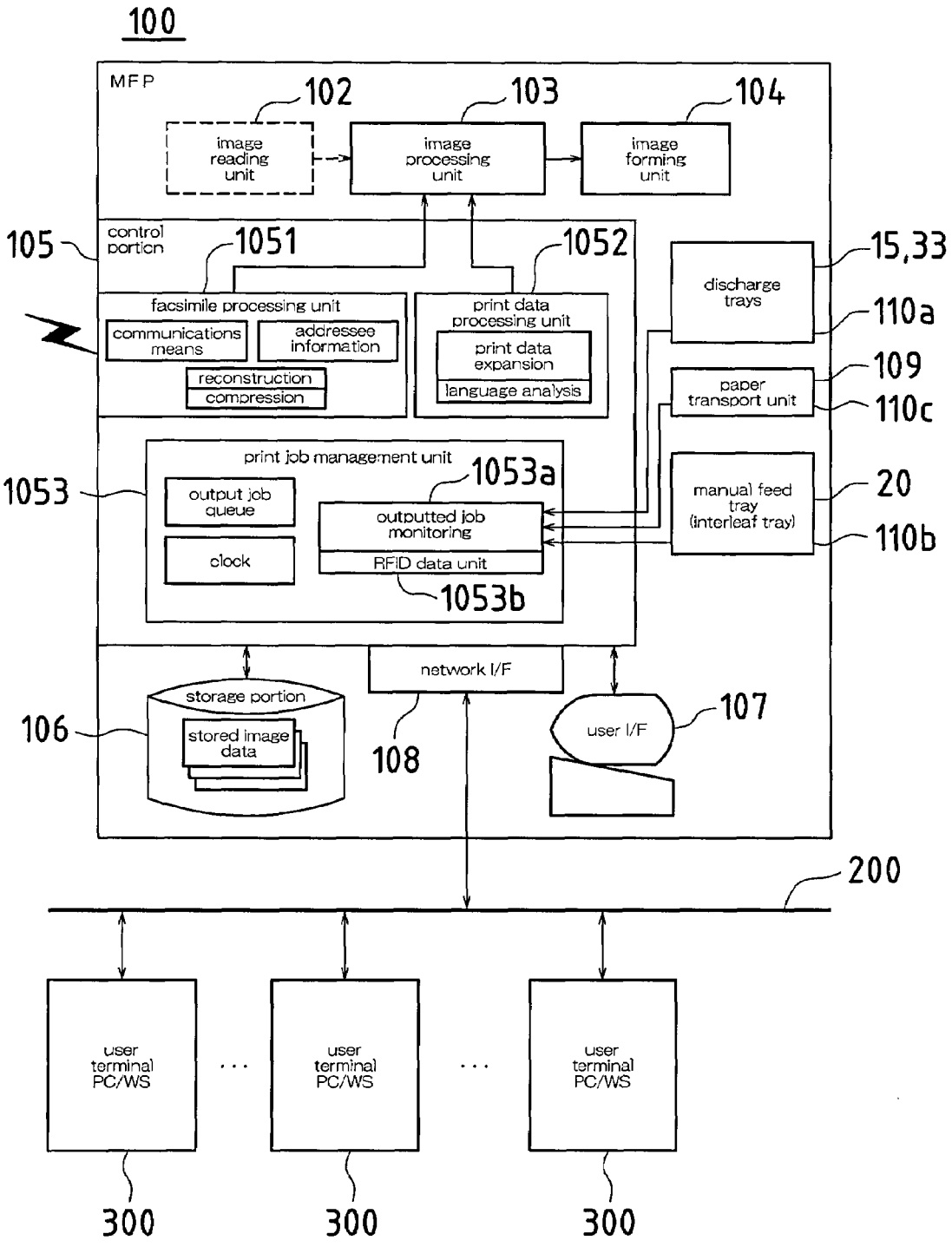
FIG. 4 is a functional block diagram of a digital color multifunction machine according to an embodiment of the present invention.

A functional block diagram of the multifunction machine 100 of the above-described configuration is shown in FIG. 4. FIG. 4 shows an MFP (multifunction printer) connected by a network to user terminals 300 via a LAN 200 connection. MFP refers to a multifunction printer provided with functions for copying, faxing, and scanning in addition to its printing functions.

An MFP 100 shown in FIG. 4 is constituted by an image reading unit 102, an image processing unit 103, an image forming unit 104, a control portion 105, a storage portion 106, a user I/F 107, a network I/F 108, and a paper transport unit 109 made of such components as the discharge trays 15 and 33 and the carry rollers 36 shown in FIG. 1.

Images are read in the image reading unit 102 using the scanning function or copying function. The image processing unit 103 transmits signals for forming images to the image forming unit 104 while performing correction on the signals. The image forming unit 104 carries out printing based on the signals received from the image processing unit 103.

The storage portion 106 stores image data and the like that has been received from outside and read in.

The user I/F 107 is constituted by a touch panel or buttons for example, and displays messages to a user and receives commands from the user.

The control portion 105 is constituted by a facsimile processing unit 1051, a print data processing unit 1052, and a print job management unit 1053.

The facsimile processing unit 1051 receives communications from outside, reconstructs the data, and transmits this to the image processing unit 103. When sending data externally, the facsimile processing unit 1051 compresses the data for sending. It also registers information of the addressee for sending.

The print data processing unit 1052 uses language analysis to expand print data and transmits this to the image processing unit 103. The print job management unit 1053 manages an order of a plurality of image formation jobs based on an output job queue.

<Description of Removal Processing Operation for Toner Adhering to Toner Layer Regulating Blades According to the Present Invention>

With the multifunction machine 100 of the above-described structure in the present embodiment, when a print job is executed by the control portion 105 and completion of the single print job is confirmed by the print job management unit 1053, the control portion 105 stops image formation processing (that is, development processing for the development apparatus) at this point and causes the development roller 21 and the photosensitive drum 3 to rotate slightly in a reverse direction (R2 direction in FIG. 3) to that during development. At this time, a development bias voltage of from 0 V to +300 V, which is opposite to that during image formation is applied. The surface electric potential of the photosensitive body at the time of completion of a print job is from −200 V to −100 V, and therefore the toner can be prevented from adhering to the surface of the photosensitive body during reverse rotation by applying the development bias at from 0 V to +300 V.

Due to this operation, the toner that has adhered by this print job mainly to the upstream side of the toner layer regulating blades 23 and 24 in a compressed state is loosened, and is removed by being pushed back in the upstream direction of the toner layer regulating blades 23 and 24.

Here a movement distance T on the surface of the development roller 21 at the time of reverse rotation is set within a range from a position at a time of development stoppage to immediately prior to where the tip end 53 of the toner scattering prevention sheet 51 goes into a non-contact state with the surface 41 of the photosensitive drum 3. Specifically, it is set within a range in which a pressure contact line L0 (see FIG. 6) between the tip end 53 of the toner scattering prevention sheet 51 and the surface 41 of the photosensitive drum 3 does not deviate even if the curvature direction of the toner scattering prevention sheet 51 changes due to reverse rotation. It should be noted that since FIG. 6 is a cross-sectional view, the pressure contact line L0 is indicated as a point in FIG. 6, but in fact contact is made extending along an entire length in a shaft core direction of the photosensitive drum 3.

Figure 5:
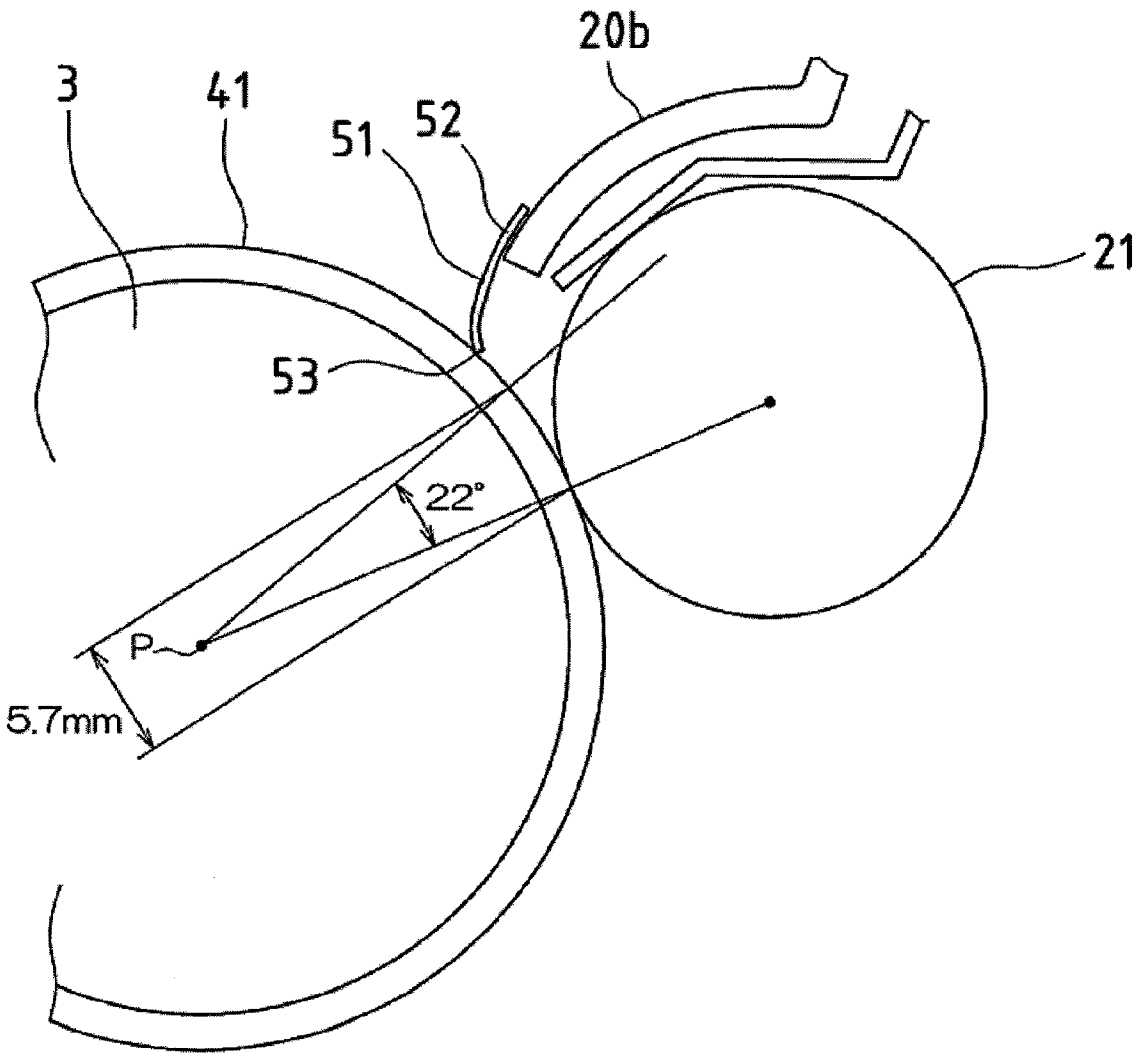
FIG. 5 is an explanatory diagram illustrating a testing result of movement distances during reverse rotation.

As shown in FIG. 5, a result of testing is that by performing reverse rotation with a rotation angle of the photosensitive drum 3 of approximately 22 degrees and with a movement distance of the surface 41 of the photosensitive drum 3 (that is, movement distance of the surface of the development roller 21) of approximately 5.7 mm, excellent removal can be achieved of toner adhered to the toner layer regulating blades 23 and 24. Consequently, the movement distance T at the time of reverse rotation may be set anywhere within a range containing this 5.7 mm. However, as a result of testing, a lesser effect was obtained when the distance of the reverse rotation was short, and therefore it is preferable that the movement distance T is set within a range of 2 to 6 mm for example. It is preferable that the rotation angle is set within a range of 7 to 23 degrees.

Figure 6:
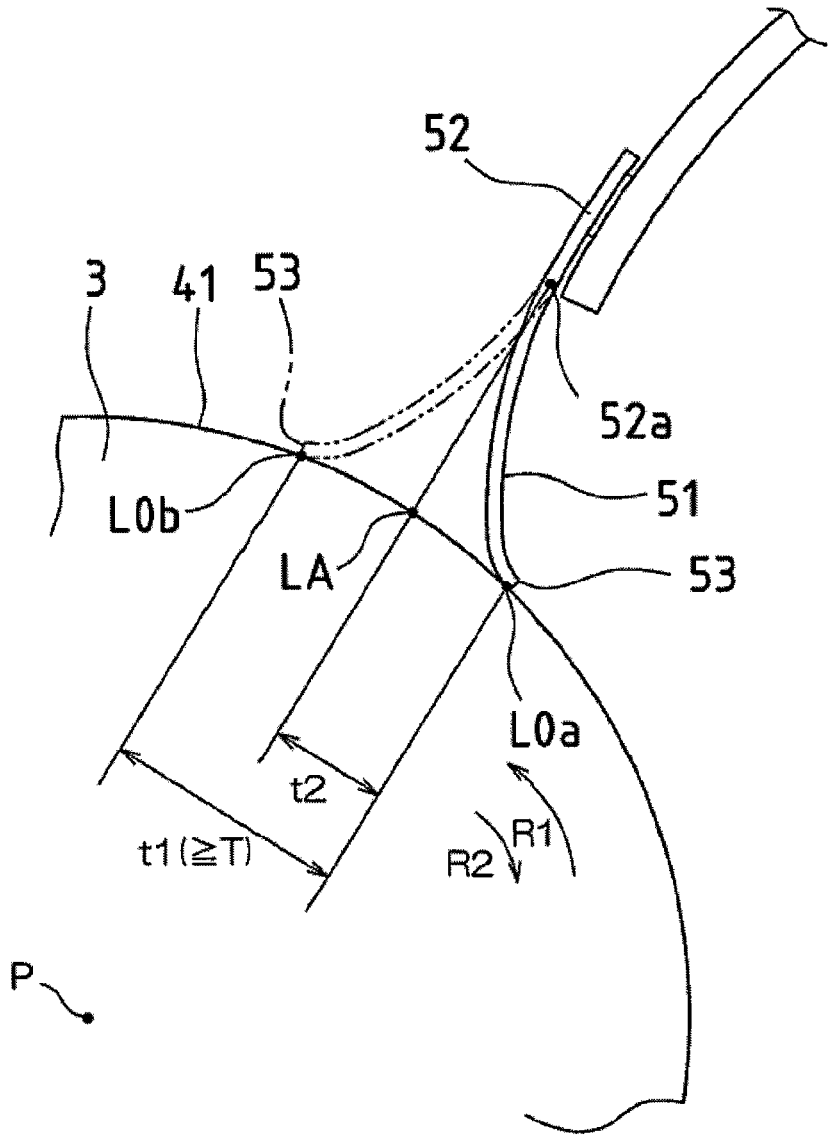
FIG. 6 is an explanatory diagram illustrating a deformation manner of a toner scattering prevention sheet during reverse rotation.

Here, as shown in FIG. 6, since the photosensitive drum 3 rotates in the R1 direction shown in the drawing during development, the pressure contact line L0 of the tip end 53 of the toner scattering prevention sheet 51 and the surface 41 of the photosensitive drum 3 is in a position of L0*a* shown in the drawing as a result of the toner scattering prevention sheet 51 curving in a state indicated by the solid line. From this state, when the photosensitive drum 3 is made to rotate in reverse in the R2 direction shown in the drawing during a non-development time after development has stopped, the tip end 53 of the toner scattering prevention sheet 51 moves following the rotation of the photosensitive drum 3, and when the tip end 53 exceeds a line of intersection (reference line) LA between a straight line joining the fixed end center 52*a* of the toner scattering prevention sheet 51 and a rotational center P of the photosensitive drum 3 and the surface 41 of the photosensitive drum 3, the curved shape of the toner scattering prevention sheet 51 inverts and curves to the state shown by the dashed line in the drawing. The position of the pressure contact line L0 at this time is a position of L0*b* shown in the drawing.

That is, in the area from the position L0*a* to L0*b* shown in FIG. 6, the pressure contact line L0 follows the rotation of the photosensitive drum 3 due to the elasticity of the toner scattering prevention sheet 51, and the tip end 53 of the toner scattering prevention sheet 51 does not deviate from the contact (pressure contact) position of the surface 41 of the photosensitive drum 3. Accordingly, in the present invention, the movement distance T during reverse rotation of the surface of the development roller 21 (that is, corresponding to the movement distance T during reverse rotation of the surface of the photosensitive drum 3, see FIG. 6) may be set anywhere within a range of a distance t1 by which the pressure contact line L0 moves from the position L0*a* to the position L0*b*.

Thus, even for reverse rotation of up to the movement distance T, the tip end 53 of the toner scattering prevention sheet 51 does not come apart from the surface 41 of the photosensitive drum 3 and the contact position at the surface 41 of the photosensitive drum 3 does not deviate, and therefore toner in the development tank 20 does not outflow or scatter externally from the opening 20*a* due to reverse rotation. Accordingly, it is possible to prevent the exposure units (1*a*, 1*b*, 1*c*, and 1*d*) arranged near the photosensitive drums 3 and near the development tanks 20 from being soiled by toner scattering.

Incidentally, in the above-described operation of the toner scattering prevention sheet 51, due to such factors as the material and thickness of the toner scattering prevention sheet 51 and the extent of pressing force and curvature to the surface 41 of the photosensitive drum 3, the tip end 53 rebounds due to a reaction when the curved form of the toner scattering prevention sheet 51 inverts when the pressure contact line L0 exceeds the reference line LA and rotates in reverse such that there is a possibility that it slightly rises from the surface 41 of the photosensitive drum 3 or that the contact position deviates. In this case, there is a possibility that internal toner will outflow or scatter externally due to this rebound action.

For this reason, giving further consideration to such a case, the movement distance T at the time of reverse rotation may be set to within a range in which the tip end 53 of the toner scattering prevention sheet 51 does not exceed the reference line LA (that is, within a range of a distance t2 from the position L0*a* to the reference line LA).

It should be noted that in the foregoing description of the removal processing operation for adhering toner, the removal processing operation was carried out after completion of a single print job, but the removal processing operation is not limited to after completion of a print job. For example, when the development roller is working (rotating) due to a warm up operation during powering up of the image forming apparatus, toner adheres to the toner layer regulating blades because of this warming up operation, so the removal processing operation may also be executed immediately after the development roller stops working (rotating) upon completion of the warm up. In other words, when the development roller works (rotates) in any of the various operational modes of the image forming apparatus, the removal processing operation may be executed after completion of that operational mode (after completion of working of the development roller).

INDUSTRIAL APPLICABILITY

The present invention may be suitably applied when removing toner that has adhered to a toner layer regulating blade in an image forming apparatus such as a copier, printer, or facsimile machine in which a development apparatus having a toner layer regulating blade is fitted.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus provided with a one-component development apparatus having a toner layer regulating blade for regulating a thickness of a toner layer on a surface of a developer bearing member that contacts a photosensitive body, wherein at a non-development time after completion of operation of the developer bearing member, the developer bearing member is caused to rotate slightly in a direction reverse to that during development and the photosensitive body is also caused to simultaneously rotate in reverse when the developer bearing member is caused to rotate in reverse, wherein a toner scattering prevention sheet is provided such that a tip end thereof contacts a surface of the photosensitive body, near an opening of a development tank that accommodates the developer bearing member, and wherein a movement distance of the surface of the developer bearing member at a time of reverse rotation is within a range from a position at a time of development stoppage to immediately prior to where the toner scattering prevention sheet that contacts the photosensitive body goes into a non-contact state with the photosensitive body.

2. The image forming apparatus according to claim 1, wherein a development bias voltage is applied during the reverse rotation of from 0 V to +300 V, which is opposite to that during image formation.

3. The image forming apparatus according to claim 2, wherein two toner layer regulating blades are provided, a first toner layer regulating blade and a second toner layer regulating blade.

4. The image forming apparatus according to claim 2, wherein a toner scattering prevention sheet is provided such that a tip end thereof contacts a surface of the photosensitive body, near an opening of a development tank that accommodates the developer bearing member.

5. The image forming apparatus according to claim 1, wherein two toner layer regulating blades are provided, a first toner layer regulating blade and a second toner layer regulating blade.

6. The image forming apparatus according to claim 5, wherein an optical component is arranged near the photosensitive body.

7. The image forming apparatus according to claim 1, wherein a rotation angle at a time of reverse rotation of a surface of the developer bearing member is within a range of 7 to 23 degrees.

8. The image forming apparatus according to claim 1, wherein an optical component is arranged near the photosensitive body.

9. An image forming apparatus provided with a one-component development apparatus having a toner layer regulating blade for regulating a thickness of a toner layer on a surface of a developer bearing member that contacts a photosensitive body, wherein at a non-development time after completion of operation of the developer bearing member, the developer bearing member is caused to rotate slightly in a direction reverse to that during development and the photosensitive body is also caused to simultaneously rotate in reverse when the developer bearing member is caused to rotate in reverse, wherein a toner scattering prevention sheet is provided such that a tip end thereof contacts a surface of the photosensitive body, near an opening of a development tank that accommodates the developer bearing member, and wherein in a state where the toner scattering prevention sheet is formed of an elastic material and a tip end thereof is arranged in a curved shape so as to press against a surface of the photosensitive body, a movement distance of the surface of the developer bearing member at a time of reverse rotation is within a range in which a pressure contact line between the tip end of the toner scattering prevention sheet and the surface of the photosensitive body does not deviate even when a curvature direction of the toner scattering prevention sheet changes due to reverse rotation.

10. The image forming apparatus according to claim 9, wherein two toner layer regulating blades are provided, a first toner layer regulating blade and a second toner layer regulating blade.

11. An image forming apparatus provided with a one-component development apparatus having a toner layer regulating blade for regulating a thickness of a toner layer on a surface of a developer bearing member that contacts a photosensitive body, wherein at a non-development time after completion of operation of the developer bearing member, the developer bearing member is caused to rotate slightly in a direction reverse to that during development and the photosensitive body is also caused to simultaneously rotate in reverse when the developer bearing member is caused to rotate in reverse, wherein a toner scattering prevention sheet is provided such that a tip end thereof contacts a surface of the photosensitive body, near an opening of a development tank that accommodates the developer bearing member, and wherein in a state where the toner scattering prevention sheet is formed of an elastic material and a tip end thereof is arranged in a curved shape so as to press against a surface of the photosensitive body, when a line of intersection between a straight line joining a fixed end center of the toner scattering prevention sheet and a rotational center of the photosensitive body and the surface of the photosensitive body is set as a reference line, a movement distance of the surface of the developer bearing member at a time of reverse rotation is within a range in which the tip end of the toner scattering prevention sheet does not exceed the reference line.

12. The image forming apparatus according to claim 11, wherein two toner layer regulating blades are provided, a first toner layer regulating blade and a second toner layer regulating blade.

* * * * *